7/28/81 XR 4,281,035

United States Patent [19]

Hawthorne et al.

[11] 4,281,035

[45] Jul. 28, 1981

[54] MARKING COMPOSITION AND METHOD OF USING SAME

[75] Inventors: Peter F. Hawthorne, Sutton Coldfield; Peter J. Rollin, Tamworth, both of England

[73] Assignee: Foseco International Limited, Birmingham, England

[21] Appl. No.: 13,901

[22] Filed: Feb. 22, 1979

[30] Foreign Application Priority Data

Feb. 22, 1978 [GB] United Kingdom ..... 6996/78

[51] Int. Cl.[3] ..... B41M 1/28

[52] U.S. Cl. ..... 427/199; 106/19; 106/300; 427/190; 427/197; 428/570

[58] Field of Search ..... 106/19, 308 B, 302, 106/304, 306, 300; 428/386, 404, 432, 457, 539, 472, 570; 427/318, 427, 216, 218, 197, 199, 424, 190; 252/140, 174.25

[56] References Cited

U.S. PATENT DOCUMENTS

| | | | |
|---|---|---|---|
| 2,144,577 | 1/1939 | Walter | 106/300 |
| 2,150,235 | 3/1939 | McKinney | 106/300 |
| 3,178,303 | 4/1965 | Township | 106/300 |
| 3,505,088 | 4/1970 | Luginsland et al. | 106/300 |
| 3,560,234 | 2/1971 | Holbein | 106/300 |
| 3,567,479 | 3/1971 | Portes et al. | 106/300 |
| 3,648,349 | 3/1972 | Schaumberg | 427/318 |
| 3,767,455 | 10/1975 | Claridge et al. | 106/300 |
| 3,981,737 | 9/1976 | Evilampi et al. | 106/300 |

FOREIGN PATENT DOCUMENTS

| | | |
|---|---|---|
| 2078231 | 10/1971 | France . |
| 1495097 | 12/1977 | United Kingdom . |

OTHER PUBLICATIONS

Chem. Abstracts 62 2486e.
Chem. Abstracts 74 66913j.
CA 70 43498f.
CA 69 110,670a.
CA 73 58,958s.
CA 73 29,621w.

*Primary Examiner*—V. P. Hoke
*Attorney, Agent, or Firm*—Leydig, Voit, Osann, Mayer & Holt, Ltd.

[57] ABSTRACT

A composition is provided for marking hot metal objects, which may be moving e.g. steel bar emerging from a rolling mill. The composition is in powder form and comprises a major weight proportion of refractory pigment and a fusible adhesion agent therefor. For marking, the composition may be applied in a carrier gas, optionally through a stencil, to the surface of the object and allowed to adhere there. Clear, durable markings are obtainable.

8 Claims, No Drawings

MARKING COMPOSITION AND METHOD OF USING SAME

This invention relates to the marking of hot metal objects, in particular to compositions for this purpose and their use for the purpose. The objects may have a temperature of 250° C. or more and the invention is especially valuable where the temperature is 600° C. or more.

Hot metal objects may require marking when they are stationary, or when they are moving at high speeds, in which case only a limited time is available for doing the marking. An example of the latter case is a hot metal bar moving at about 27 meters/minute past an inspection device and requiring to be marked at any point where the inspection device reveals a flaw. Ingots can be marked by including an indicium-defining body in the mould during casting as described in British patent specification No. 1 460 292 and clear, durable markings are obtainable that are still clearly visible after rolling. The present invention however enables hot metal objects that have already been formed to be given clear, durable markings and is applicable to moving as well as stationary objects.

According to the invention a composition for marking a hot metal object is in powder form and comprises a major proportion by weight of a refractory pigment and a fusible adhesion agent therefor.

The pigment is titanium dioxide, which preferably forms at least 60% by weight of the composition and the amount may be up to 90% or even more. The fusible adhesion agent is trisodium polyphosphate. The composition preferably contains from 1 to about 40% by weight of the adhesion agent, more preferably 2 to 35% and above all 10 to 25%.

The composition may include an additive to enhance the flowability of the composition. Such an additive, hereafter termed 'free-flowing additive', is preferably an aluminosilicate or calcium phosphate. The free-flowing additive can be of particular assistance in entraining the composition in a carrier gas for spraying the composition onto the hot metal object to mark it.

The presence of water in an amount of more than 5% by weight for example in the composition is not preferred as it tends to result in agglomeration of the powder particles. However, 0.1 to 2% by weight of water can be beneficial in preventing a suspension of the composition in a carrier gas being excessively mobile and tending to be too dispersed and to yield a less dense and less clearly defined marking.

The particles in the composition are preferably below 60 mesh (B.S.S.) sieve size, more preferably below 100 mesh.

According to the invention a method of marking a hot metal object comprises applying in a carrier gas a composition according to the invention to the surface of the hot metal object and allowing the composition to adhere to the object.

The hot metal object may be a metal, e.g. steel, bar or rod or part of a billet emerging from a rolling mill. In the case of the billet this may be rolled into bar which is then cut up and there is a need to mark the leading portion of the moving bar as this is likely to have most segregation. The object may be stationary e.g. an ingot or slab. Whether or not the object is moving the composition may be applied through a stencil to aid obtaining a marking of a pre-determined shape.

Metal objects, e.g. ones of ferrous metals such as steel, commonly have a surface oxide layer of greater or lesser thickness but clear, durable markings on such objects may be obtained by use of compositions according to the invention without any need to remove or pre-treat the oxide layer. If, however, there is a poorly adhering layer of scale it is preferred to remove this before applying the composition. Furthermore, it is not essential to apply the composition in a reducing atmosphere. Also, no reducing agent needs to be included in the composition: indeed, the composition preferably consists of refractory pigment, fusible adhesion agent and any free-flowing additive. The composition of the invention has the advantage that it contains a high proportion of the effective marking ingredient, namely the pigment, thus enabling clear markings to be obtained without the need for high application rates of the composition.

The temperature of the object to which the composition is applied may range from 250° C. to 1200° C. and the invention is especially valuable if the temperature is at least 600° C. Fusion, partial or complete, of the fusible adhesion agent aids the formation of a marking that is well bonded to the surface to which the composition is applied. Highly durable, clear markings can readily be obtained by means of the invention. Markings having substantial resistance to abrasion are obtainable. In some cases, for reasons unconnected with the marking, the hot object may be quenched with water after the marking operation and markings able to withstand this satisfactorily may be obtained by use of the invention.

A specific instance of a case in which the composition and method are useful is where hot metal e.g. steel bar emerging from a rolling mill is checked by a eddy current flaw detector. The detector can be incorporated in a system that causes a spray gun to eject a dose of a composition according to the invention in a carrier gas on to the bar to form a marking on a portion detected to be faulty.

The invention includes a metal object marked by the method.

The invention is illustrated by the following Example.

EXAMPLE

The following ingredients, all as particles below 100 mesh sieve size (B.S.S.), were mixed together in the proportions specified:

| | |
|---|---|
| titanium dioxide | 79% by weight |
| tri-sodium polyphosphate | 20% by weight |
| free-flowing additive | 1% by weight |

The composition was sprayed, using air as carrier gas, onto steel bar at 1000° C., the bar moving at 10 m./minute, and a conspicuous, durable marking resulted.

We claim:

1. A composition in powder form for marking a hot metal object, consisting essentially of titanium dioxide as a refractory pigment in a major proportion by weight and trisodium polyphosphate as a fusible adhesion agent for adhering said pigment to said object said pigment and said adhesion agent being below 60 mesh.

2. A composition according to claim 1 containing at least 60% by weight of said refractory pigment.

3. A composition according to claim 1 containing 10 to 25% by weight of said fusible adhesion agent.

4. A composition according to claim 1 containing a free-flowing additive enhancing the flowability of the composition said free-flowing additive enhancer being below 60 mesh.

5. A method of marking a hot metal object comprising applying to a surface of said object a composition, in powder form and suspended in a carrier gas, which composition consists essentially of titanium dioxide as a refractory pigment in a major proportion by weight and trisodium polyphosphate as a fusible adhesion agent for adhering said pigment to said object, and allowing said composition to adhere to the object to form a marking on said object said pigment and said adhesion agent being below 60 mesh.

6. A method according to claim 5 in which said object is moving.

7. A method according to claim 5 in which said object is at a temperature of at least 600° C.

8. A metal object having on a surface thereof a marking applied by a method according to claim 5.

* * * * *